US009675836B2

(12) United States Patent
Babon

(10) Patent No.: US 9,675,836 B2
(45) Date of Patent: Jun. 13, 2017

(54) EXERCISE APPARATUS AND KIT

(71) Applicant: Thomas Joseph Babon, Katonah, NY (US)

(72) Inventor: Thomas Joseph Babon, Katonah, NY (US)

(73) Assignee: Thomas Babon, Katonah, NY (US)

( * ) Notice: Subject to any disclaimer, the term of this patent is extended or adjusted under 35 U.S.C. 154(b) by 0 days.

(21) Appl. No.: 14/748,366

(22) Filed: Jun. 24, 2015

(65) Prior Publication Data

US 2015/0375034 A1 Dec. 31, 2015

Related U.S. Application Data

(60) Provisional application No. 62/016,885, filed on Jun. 25, 2014.

(51) Int. Cl.

| | |
|---|---|
| ***A63B 21/04*** | (2006.01) |
| ***A63B 21/16*** | (2006.01) |
| ***A63B 23/02*** | (2006.01) |
| ***A63B 21/02*** | (2006.01) |
| ***A63B 21/045*** | (2006.01) |
| ***A63B 21/00*** | (2006.01) |

(52) U.S. Cl.

CPC .... *A63B 21/1681* (2013.01); *A63B 21/00069* (2013.01); *A63B 21/023* (2013.01); *A63B 21/045* (2013.01); *A63B 21/0442* (2013.01); *A63B 21/169* (2015.10); *A63B 21/1636* (2013.01); *A63B 21/4005* (2015.10); *A63B 21/4035* (2015.10); *A63B 23/0211* (2013.01); *A63B 23/0227* (2013.01); *A63B 2208/0204* (2013.01); *A63B 2210/50* (2013.01)

(58) Field of Classification Search

CPC ..... A63B 21/1681; A63B 21/1636; A63B 21/169; A63B 21/4035; A63B 21/4005; A63B 21/045; A63B 21/0442; A63B 21/00069; A63B 23/0227; A63B 23/0211; A63B 2210/50; A63B 2208/0204

See application file for complete search history.

(56) References Cited

U.S. PATENT DOCUMENTS 2,959,414 A 11/1960 Saltz
3,814,084 A 6/1974 Gustafson
(Continued)

*Primary Examiner* — Loan H Thanh
*Assistant Examiner* — Megan Anderson
(74) *Attorney, Agent, or Firm* — Andrew F. Young, Esq.; Lackenbach Siegel, LLP

(57) ABSTRACT

An exercise apparatus may include: a housing including a height configured to be mounted to a surface, a first longitudinal axis extending through the height; a biasing member, the biasing member including a substantially rigid upper section, a substantially rigid lower section, and a flexible joint therebetween, the flexible joint providing a flexural resistance, wherein the lower section is coupled to the housing and a second longitudinal axis extends through the upper section; and a handle coupled to the upper section, wherein the biasing member is transitionable between a first position in which the first longitudinal axis and the second longitudinal axis are generally parallel or collinear, and a second position in which the first longitudinal axis and the second longitudinal axis are orthogonal with respect to one another, the biasing member being biased to toward the first position. A kit including the same is also disclosed.

13 Claims, 8 Drawing Sheets

(56) References Cited

U.S. PATENT DOCUMENTS

| | | | | |
|---|---|---|---|---|
| 3,915,452 | A | 10/1975 | Winblad | |
| 3,947,025 | A * | 3/1976 | Hobby, Jr. | A63B 21/04 482/123 |
| 4,529,191 | A | 7/1985 | Miller et al. | |
| 4,606,541 | A | 8/1986 | Kirkpatrick | |
| 4,627,619 | A | 12/1986 | Rockwell et al. | |
| 4,634,127 | A | 1/1987 | Rockwell | |
| 4,662,629 | A | 5/1987 | Plovie | |
| 4,747,594 | A | 5/1988 | Houde | |
| 4,844,448 | A | 7/1989 | Niznik | |
| 4,856,776 | A * | 8/1989 | Ching-Liang | A63B 21/045 482/122 |
| 4,896,881 | A | 1/1990 | Djerdjerian | |
| 5,048,825 | A | 9/1991 | Kelly | |
| 5,100,130 | A | 3/1992 | Shoebrooks | |
| 5,135,445 | A | 8/1992 | Christensen et al. | |
| 5,180,350 | A | 1/1993 | Thomas | |
| 5,288,283 | A | 2/1994 | Meeker | |
| D348,706 | S | 7/1994 | Harrell | |
| 5,407,414 | A | 4/1995 | Bass | |
| 5,417,628 | A | 5/1995 | Vanderbleek | |
| 5,429,571 | A | 7/1995 | Smith et al. | |
| 5,468,205 | A | 11/1995 | McFall et al. | |
| 5,526,649 | A | 6/1996 | Sada | |
| 5,540,641 | A | 7/1996 | Williams et al. | |
| 5,540,643 | A | 7/1996 | Fontaine | |
| 5,626,546 | A | 5/1997 | Little | |
| 5,800,323 | A | 9/1998 | Ansel | |
| 5,839,994 | A | 11/1998 | Elbogen | |
| 5,910,073 | A | 6/1999 | Conner | |
| 5,984,836 | A | 11/1999 | Casali | |
| 6,179,748 | B1 | 1/2001 | Barr | |
| 6,248,047 | B1 * | 6/2001 | Abdo | A63B 21/023 482/121 |
| 6,254,517 | B1 | 7/2001 | Kennedy | |
| 6,508,743 | B1 | 1/2003 | Fortin | |
| 6,514,182 | B1 | 2/2003 | Chhloeum | |
| 6,602,171 | B1 * | 8/2003 | Tsen | A63B 21/023 482/140 |
| 6,712,742 | B2 | 3/2004 | Suiter | |
| 7,645,217 | B2 | 1/2010 | Habing et al. | |
| 7,993,245 | B1 | 8/2011 | Dorfman | |
| 8,172,726 | B1 | 5/2012 | Leier | |
| 8,221,293 | B2 | 7/2012 | Hoffman et al. | |
| 8,535,204 | B2 | 9/2013 | Stacey | |
| 9,186,544 | B1 * | 11/2015 | Kastrat | A63B 21/025 |
| 2003/0158024 | A1 | 8/2003 | Saure | |
| 2005/0250619 | A1 | 11/2005 | Daikeler et al. | |
| 2008/0051271 | A1 * | 2/2008 | Mandell | A63B 21/00043 482/122 |
| 2011/0172068 | A1 * | 7/2011 | Tyson, III | A63B 21/0455 482/127 |
| 2012/0100968 | A1 | 4/2012 | Tilton et al. | |
| 2013/0053221 | A1 | 2/2013 | Ho | |
| 2013/0212857 | A1 | 8/2013 | Donofrio | |
| 2013/0288861 | A1 | 10/2013 | Cole | |

* cited by examiner

FIG.8
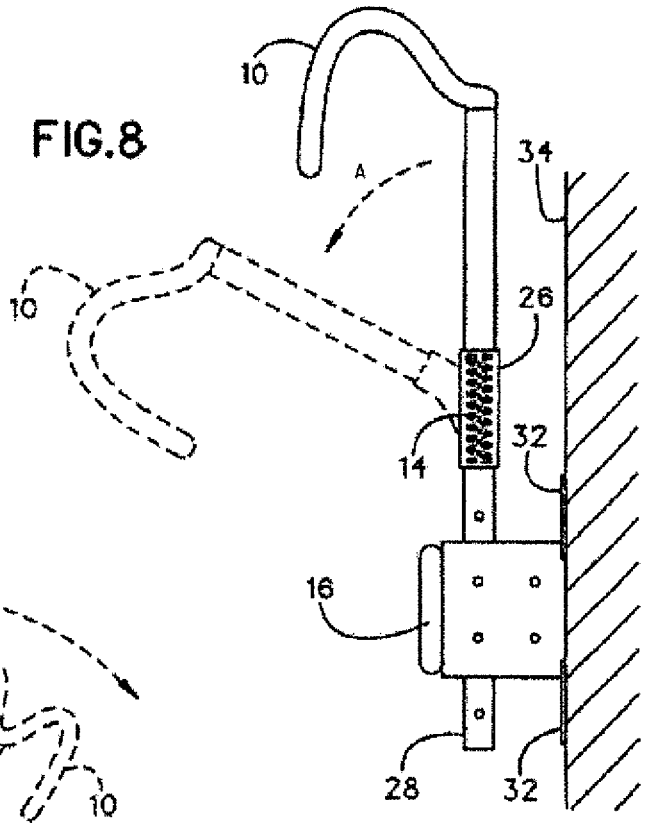
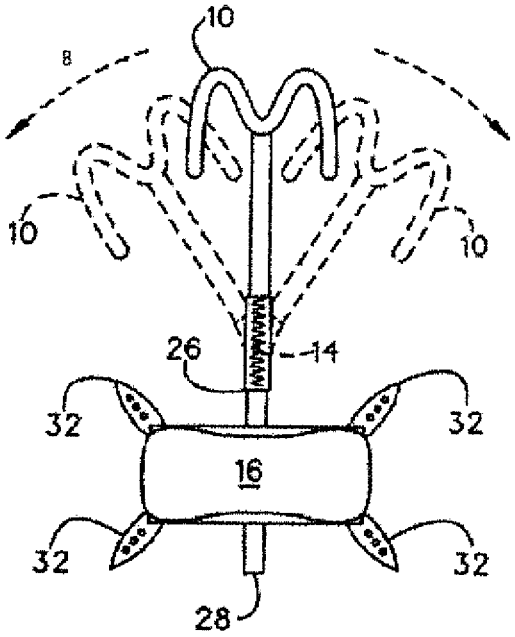
FIG.9
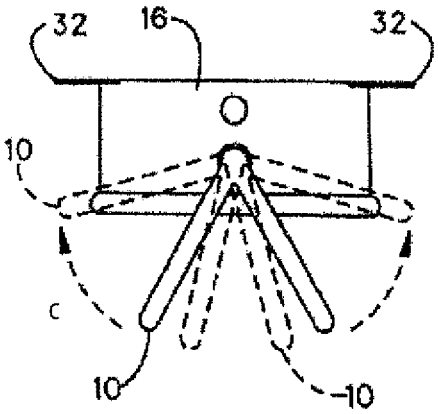
FIG.10

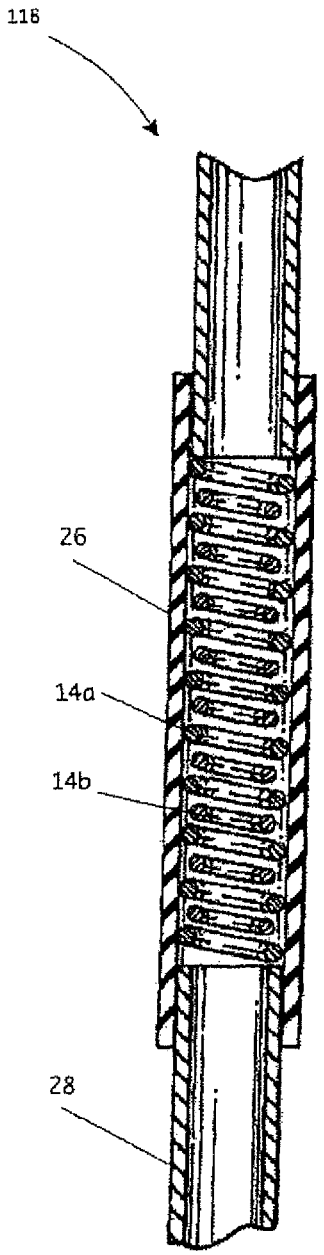
FIG. 11
FIG. 12
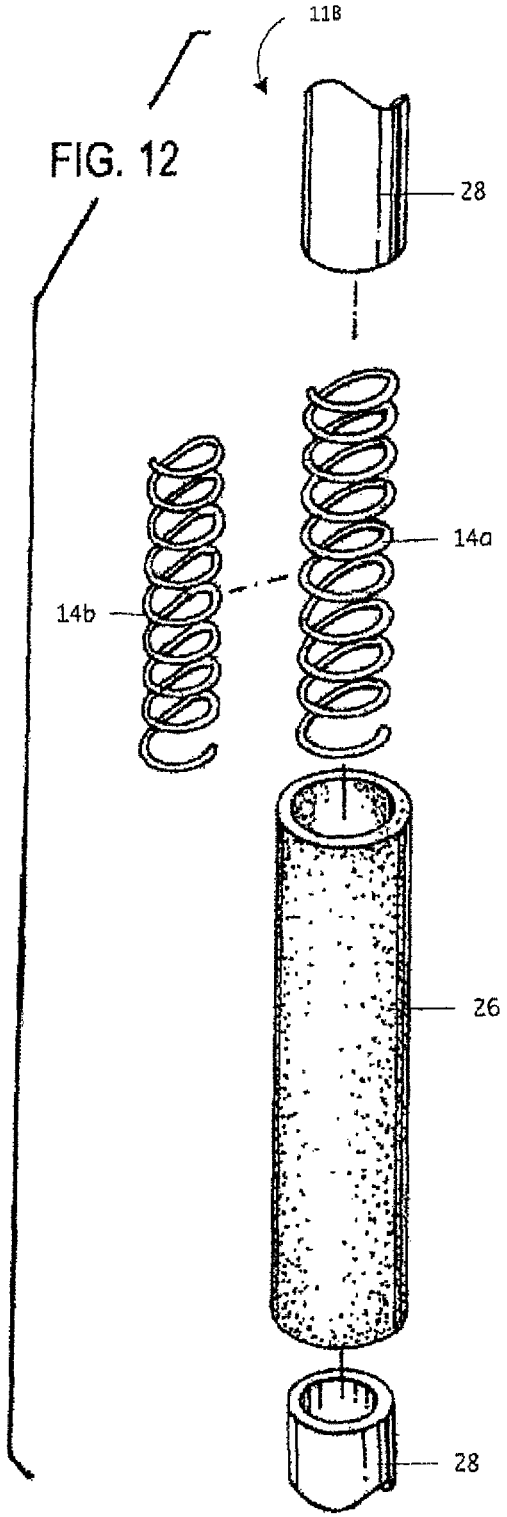

EXERCISE APPARATUS AND KIT

CROSS-REFERENCE TO RELATED APPLICATIONS

This application claims priority to and the benefit of U.S. Provisional Patent 62/016,885, filed on Jun. 25, 2014, the entire contents of which are hereby incorporated by reference herein.

BACKGROUND

Technical Field

The present disclosure generally relates to exercise apparatus and kit for components of the same, and more particularly, to a device that enables the performance of abdominal exercises in a standing up position.

Description of the Related Art

Currently, abdominal exercises are performed when in either a supine or sitting position. For a variety of reasons assuming a supine or sitting position is not ideal. For example, a lack of floor space, unclean and/or unsanitary ground surface, a lack of floor mats or other equipment that facilitate laying on a hard surface, physical impairments, and other issues may preclude or discourage one from assuming a supine or sitting position. Thus, many individuals are precluded or discouraged from engaging in heath-promoting abdominal exercises.

There is a continuing need for a device that enables or facilitates performing abdominal exercises in a standing up position.

SUMMARY AND ASPECTS OF THE INVENTION

It is now recognized that there are several detriments in the related arts, at least one of which is overcome by one aspect of the proposed disclosure.

Generally, an exercise kit, apparatus, and system may be securable to a surface such as a door. The exercise kit and apparatus facilitate performing abdominal exercises while in a standing position. The apparatus includes a biasing member that provides added flexural resistance while performing the exercises. In the kit, various biasing members may be provided, each having a different flexural resistance.

In one aspect of the present disclosure, an exercise apparatus may include: a housing including a height configured to be mounted to a surface, a first longitudinal axis extending through the height; a biasing member, the biasing member including a substantially rigid upper section, a substantially rigid lower section, and a flexible joint therebetween, the flexible joint providing a flexural resistance, wherein the lower section is coupled to the housing and a second longitudinal axis extends through the upper section; and a handle coupled to the upper section.

The biasing member may be transitionable between a first position in which the first longitudinal axis and the second longitudinal axis are generally parallel or collinear, and a second position in which the first longitudinal axis and the second longitudinal axis are orthogonal with respect to one another, the biasing member being biased to toward the first position. The flexible joint may include a flexible tube and at least one spring element disposed within the tube. The at least one spring element may include a first and second spring. The first and second springs may be intertwined such that they define a common central axis extending lengthwise therethrough. The biasing member may be releasably coupled to both the housing and the handle. A flexible sleeve may be disposed within the spring element, the sleeve being substantially aligned with the tube.

A foot rest being may be coupled to the housing. The foot rest may include a surface, the surface defining a geometric plane, the surface being transitionable between a first position in which the plane is orthogonal with respect to the first longitudinal axis and a second position in which the plane is substantially parallel to the first longitudinal axis. The biasing member may be releasably coupled to the housing and to the handle. The handle may include a pair of handles that are configured to conform to a shape of user's shoulders.

An exercise kit may include the above described exercise apparatus, and may further include a plurality of biasing members that each have a different flexural resistance value. The biasing members may be releasably coupled to the handle and to the housing such that they may be swapped for a particular biasing member having a desired flexural resistance value.

It is further understood that the proposed exercise apparatus and kit may be understood as an exercise system and operate as an integrated system for exercise.

It is further understood that one aspect of the present invention allows an adjustment of the supporting platform relative to the floor for easy door-access and use, as well as optional automatic movement of a supporting platform via an adjustment element to enhance such door-access and use.

The above and other aspects, features and advantages of the present disclosure will become apparent from the following description read in conjunction with the accompanying drawings, in which like reference numerals designate similar or the same elements.

BRIEF DESCRIPTION OF THE DRAWINGS

FIG. 8 is a side view of the part of the device as shown in FIG. 6 illustrating a range of movement and adjustment;

FIG. 9 is a front view of the part of the device as shown in FIG. 6 illustrating the range of movement;

FIG. 10 is a top view of the part of the device as shown in FIG. 6 illustrating the range of movement;

FIG. 11 is a cross-sectional view of an adaptive biasing member for use in accordance with the present disclosure and the invention noted in FIG. 1;

FIG. 12 is an exploded view of the biasing member of FIG. 11;

DETAILED DESCRIPTION OF THE PREFERRED EMBODIMENTS

Figure 2:
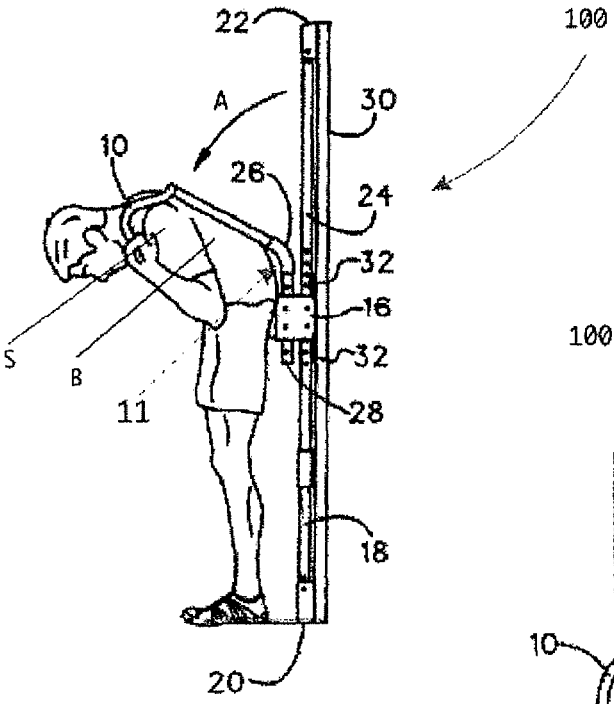
FIG. 2 is a side view of the exercise device of FIG. 1 shown in use.
Figure 1:
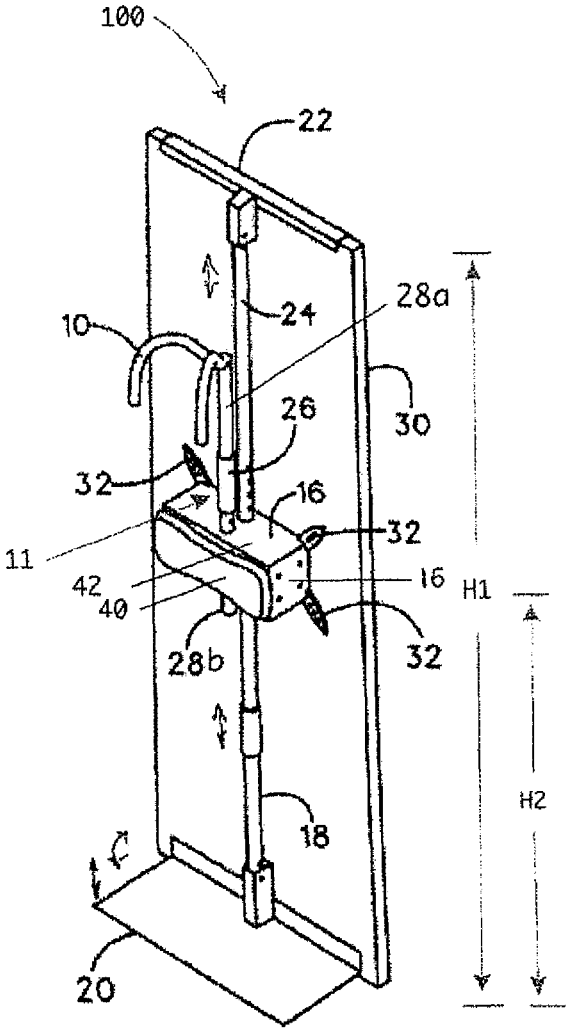
FIG. 1 is a perspective view of an exercise device in accordance with an embodiment of the present disclosure.
Figure 3:
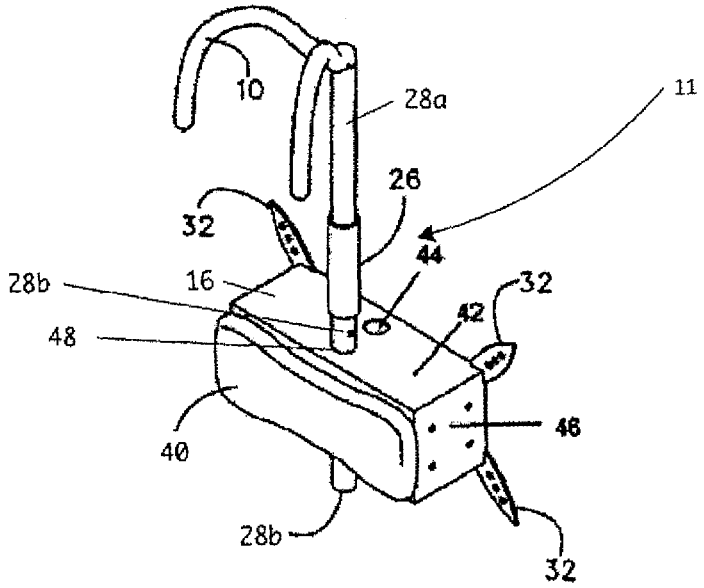
FIG. 3 is a view of a housing coupled to a biasing member of FIG. 1.

Reference will now be made in detail to embodiments of the present disclosure. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present disclosure, and that the detailed description is not to be taken in a limiting sense, and that elements may be differently positioned, or otherwise noted as in the appended claims without requirements of the written description being required thereto.

Broadly, an embodiment of the present disclosure provides an exercise apparatus. The exercise apparatus may include a pair of handle or gripping bars, a biasing member, a housing, a spring surrounded by rubber and a handle element. The housing may have a box-like shape defining a pair of aligned holes so as to slidably receive the handle element. The handle element may be connected to the handle bars by the spring surrounded by rubber that slidably receives both. The spring surrounded by rubber may form an enclosure operably housing the biasing member so that the spring sleeve acts as a hinge for the connected handle bars that the biasing member biased in an aligned position thereto. The biasing member may be adapted to provide flexural resistance when torque and/or bending is applied to the connected handle bars over a range of movement for the handle bars of at least 180 degrees.

Referring to FIGS. 1-7, an exercise apparatus 100 may include a pair of handles 10, a foot rest 20, and a door or frame 30 having a door height H1. It will be understood that where the system is used with a door 30, that the door 30 will be mounted in a door frame with hinges and having a rotational movement (not shown). A support housing 16 may be secured or coupled to the door or frame 30 at a height H2 suitable for a user's waist location (see FIG. 2). The housing 16 may include a cushioned back rest 40 against which a lower end or portion of a person's back B may rest, and the pair of handles 10 may be configured to rest upon a person's shoulders S. Additionally, housing 16 may also contain an electronic device for user convenience (discussed but not shown) such as an operative radio (music) or operative counting system (to count exercise movements).

A first handle element or an upper tube 28*a* may be operably coupled to the pair of handles 10. It will also be recognized that the pair of handles 10 may be replaced by a pair of flexible strap or web-members (noted here but not shown) allowing a user to use flexible hand-grips to connect to the upper tube 28*a* for ease of gripping. Where such flexible strap or web-members are used they would also include a handle or gripping member at the end for ease of use. As shown, the pair of handles 10 may be operably coupled to the upper tube 28*a*, which may be generally straight and may have a length substantially corresponding to the length of the person's back B. A second handle element or a lower tube 28*b* may be secured to the housing 16 at one or more positions such that the height of the lower tube 28*b* relative to the frame 30 may be adjusted.

A biasing assembly 11 may include upper and lower tubes 28*a*, 28*b* and a bendable section 13 that may be disposed between the upper and lower tubes 28*a*, 28*b* together and may couple the upper and lower tubes 28*a*, 28*b*. The upper and lower tubes 28*a*, 28*b* and the bendable section 13 may be substantially co-linear. In use, a user may position himself with the handles 10 on his shoulders and his back generally aligned with the upper tube 28*a*. The user may contract his stomach muscles to cause this back to rotate along directional arrow A which causes a corresponding bending of the bendable section 13. As a noted benefit hereof, there is no need to pressure the lower back by resting on a 'floor' to conduct a 'sit-up' motion which can be painful for some people and can be difficult to transition between floor-sitting and standing for those who are injured in their limbs or back area.

The bendable section 13 (shown best in FIG. 7) may be configured to add a resistive force in a direction opposite that of directional arrow A such that the abdominal muscles are exercised. In particular, the bendable section 13 provides flexural resistance when torque and/or bending is applied to the handle bars 10 over a range of movement for the handle bars 10 of, for example, at least 180 degrees. The bendable section 13 may include a spring element 14 that is surrounded by a flexible tube 26 that may be repeatedly bent without fracturing. For example, the flexible tube 26 may be formed from rubber, nylon, leather, various plasticized materials and the like.

An adjustable assembly 50 (see FIG. 4) may include an adjustable spring 12 (discussed below), an adjustable element 18, foot rest 20, a first mount 22, and a mounting post 24. The foot rest 20 may be coupled to the adjustment element 18. The foot rest 20 may include a receptacle 21 for slidably and optionally lockingly receiving the adjustment element 18 in a series of pin holes or pin openings 18*a* as will be discussed. Two opposing side walls of the receptacle 21 may include at least one pin opening 21*a* to securely connect to element 18 during assembly of the kit. The adjustment element 18 may include a spring for urging the separate sections of mounting post 24 relative to adjustable element 18 and proximate to a plurality spaced pin openings 18*a* so as to be adjustably secured within the receptacle 21, for example, by engaging a pin or the like, through the spaced pin openings 18*a*, 21*a* on both the opposing side walls and the adjustment element 18.

The adjustment element 18 may be interconnected to the mounting post 24 by the adjustable spring 12. The adjustable spring 12 may be configured to expand and contract so that the foot rest 20 may ergonomically lower to a supporting surface when a user steps thereon, and so that the foot rest 20 conveniently raises upwardly off the supporting surface (e.g., floor), on which the foot rest is resting, when the user dismounts so that the frame 30 may move without the foot rest 20 frictionally engaging the supporting surface. Where the frame 30 is secured to a supporting wall 34 (FIG. 6) that is for example, a door, the foot rest 20 being raised upwardly in a direction toward the door 30 or frame 30 and away from the supporting surface (e.g., floor) is particularly convenient and useful. This upward movement is noted in FIG. 5 as arrow K (for example, an upward lift of about 1.0-2.5 centimeters (about 0.5-1.0 inches) for floor clearance). Additionally, as noted in FIG. 5, pivot hinge portion 100 is noted in optional rotational curve R.

Figure 4:
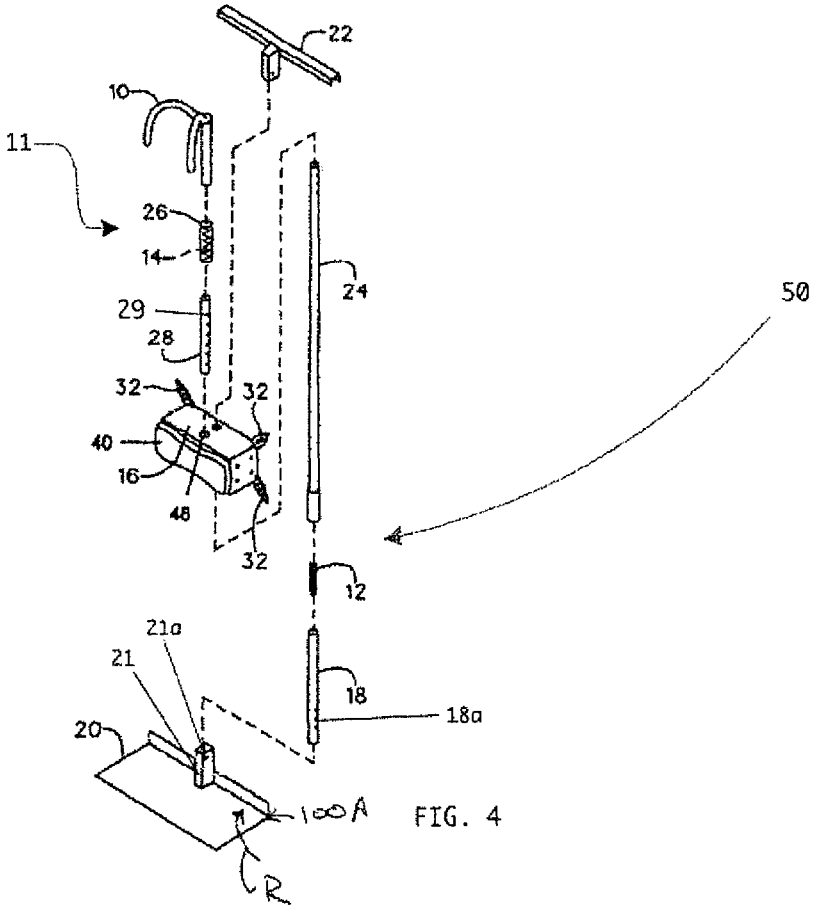
FIG. 4 is an exploded view of the device of FIG. 1.
Figure 5:
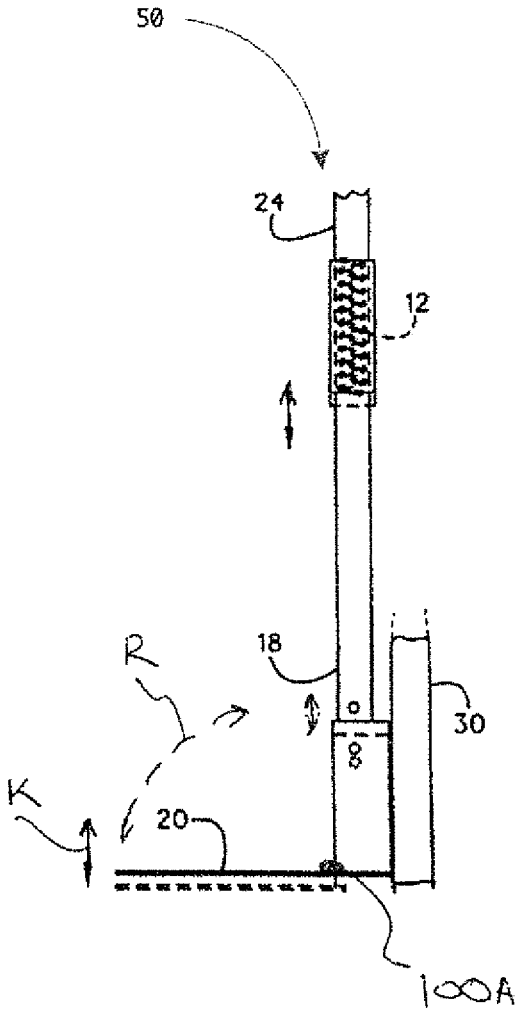
FIG. 5 is an adjustment mechanism of FIG. 1
Figure 6:
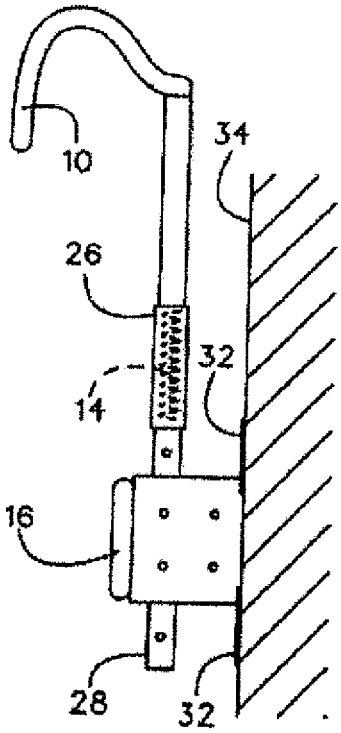
FIG. 6 is a side view of part of the device as shown in FIG. 5.
Figure 7:
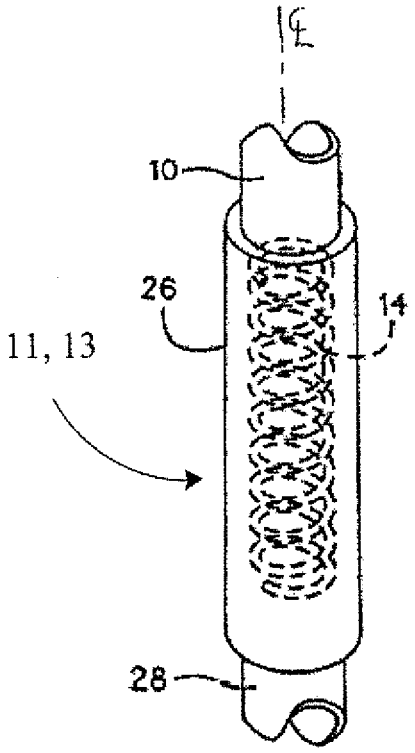
FIG. 7 is a perspective view of a portion of a biasing member of the device of FIG. 1.

Additionally, as will be noted in FIG. 4, there is an optional pivot hinge portion 100A (see FIG. 4 and FIG. 5), proximate foot rest 20 and receptacle 21 to allow storage rotation of foot rest 20 along rotational direction curve R to allow for additional opening and swing clearance for door or frame 30. Upon rotational along curve R, door 30 or frame 30 may have additional swing clearance The mounting post 24 may be coupled to the adjustment element 18 so that the adjustable assembly 50 may be longitudinally extended or retracted along the adjustable spring 12. The mounting post 24 may be connected to the first mount 22. The first mount 22 may be configured to be releasably secured to the frame 30. The frame 30 may include a door, window, wall or any other vertical support. As shown in FIG. 6, the housing 16 may be joined to at least one optional mounting bracket 32, which is may be directly secured to and/or lies flush against the supporting wall 34 (e.g., a door frame). It will be understood that mounting brackets 32 may be optionally positioned at all four corners (as shown) or may be selectively positioned on one or more corners (for stability in a particular direction) or may be removed and not used at all (optional use). When used, mounting bracket(s) 32 contain friction portions (e.g., silicon pads) and optional attachment holes (e.g., screw holes) for fixabily securing the system 100 to the door 30 or frame 30.

A method of using the exercise apparatus 100 may include detachably mounting the first mount 22 to the top of the frame 30 so that the foot rest 20 is generally parallel and adjacent to the supporting surface such as the ground or floor, etc. The user may step onto the foot rest 20 with his lower back flush against the back rest 40. The user may grasp the pair of handle bars 10 with at least one hand to perform various abdominal exercises, for improving muscle tone or for physical therapy, while in a standing-position.

As shown in FIGS. 8-10, during use, the handle bars 10 may be moved in a variety of direction. For example, a user may perform a crunch by pulling the handle bars 10 in direction A. The user may alternatively focus on lateral muscles by pulling the handle bars 10 in a sideways motion along bi-directional arrow B. Alternatively, the user may move in a twisting motion as indicated by bi-directional arrow C.

Alternative embodiments of bending mechanisms are described with reference to FIGS. 12-16 which may be understood as being an adaptive assembly that may be provided as a separate kit system, or integrated into the entire device and system 100.

As shown in FIGS. 11-12, a bending mechanism 11B may be substantially similar to the bending mechanism 11 adapted in that the bending mechanism 11B and may adaptively include a plurality (e.g., two or three or more) intertwined springs 14*a*, 14*b* (only two are shown for drawing convenience but more are to be understood) such that the resistive force of the bending mechanism 11B may be increased, decreased or otherwise modified along a length of longer spring 14*a* relative to a bending motion. The handle element 28 may be separated from the flexible tube 26 such that the number of springs within the tube 26 may be adjusted as desired to vary the resistive force. As will be understood, each spring member 14, 14*b*, 14*a*, and otherwise, has a bending (relative to a long axis) spring constant and a compressive spring constant (upon compression) which is a function of the gauge (thickness) of the spring wire, the tightness of the coil (diameter), and the tempering and metallurgical properties of the spring. Since each user may require a different resistive force for exercise, adjustment and adaptation is a substantial benefit.

For example, as will be later discussed, a first spring 14*a* may have a first length but lower spring constant than a second spring 14*b* which may have a shorter length and a higher spring constant. Such an intertwined assembly (see FIG. 11) would allow for greater initial-motion bending on either side of sleeve 26, but a more difficult central bending in the location of the second spring 14*b*. In this manner a wide variety of adaptive resistance rates, and curves, may be provided to a user for an enhanced use-benefit.

Figure 13:
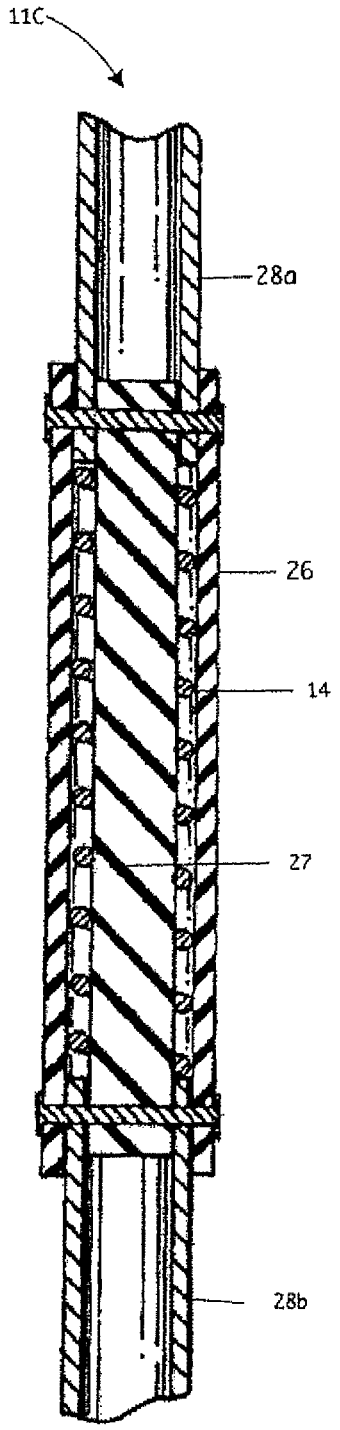
FIG. 13 is a cross-sectional view of another adaptive biasing member in accordance with the present disclosure and the invention noted in FIG. 1.
Figure 14:
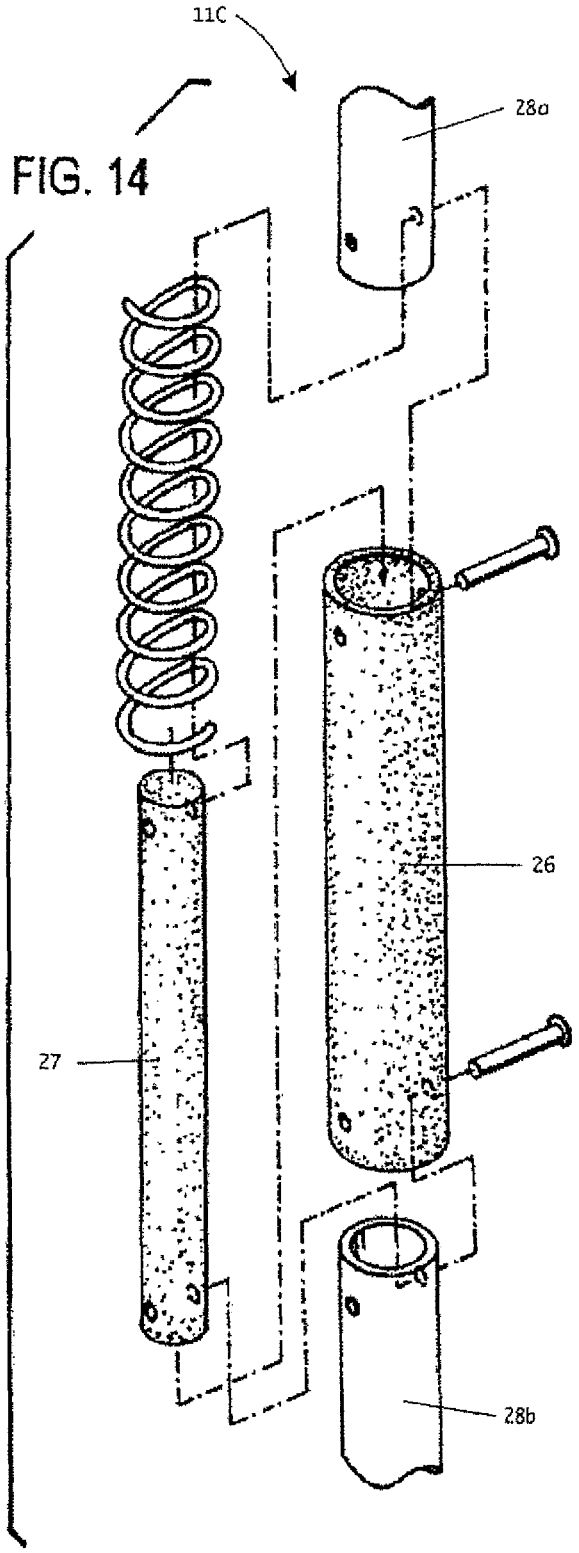
FIG. 14 is an exploded view of the biasing member of FIG. 13.

As shown in FIGS. 13-14, a bending mechanism 11C may be substantially similar to the bending mechanism 11 except that the bending mechanism 11C but may adaptively and alternatively may include an inner flexible sleeve member 27 that may be formed from a similar material as the flexible tube 26 as a sort of elastomeric insert. The sleeve 27 may be tubular or may be cylindrical and is shaped to fit within the spring members (14, 14*a*, 14*b*, etc.). Spring 14 may be disposed around the sleeve member 27. The sleeve 27 may ensure provide added flexural resistance to the bending mechanism 11C, and may also facilitate a predictable bending the spring 14 and may ensure that the spring retains its diameter during bending. It will be understood, that as one adaptive version of the present invention, that flexible sleeve member 27 may be separately provided as a kit element, for example in a series of similarly-sized but differently-flexible members that may be interchanged and assembled by a user selection from a plurality of alternatives. (See FIG. 14 for example of one version where the sleeve 27 shown is assembled for a particular use.)

Figure 15:
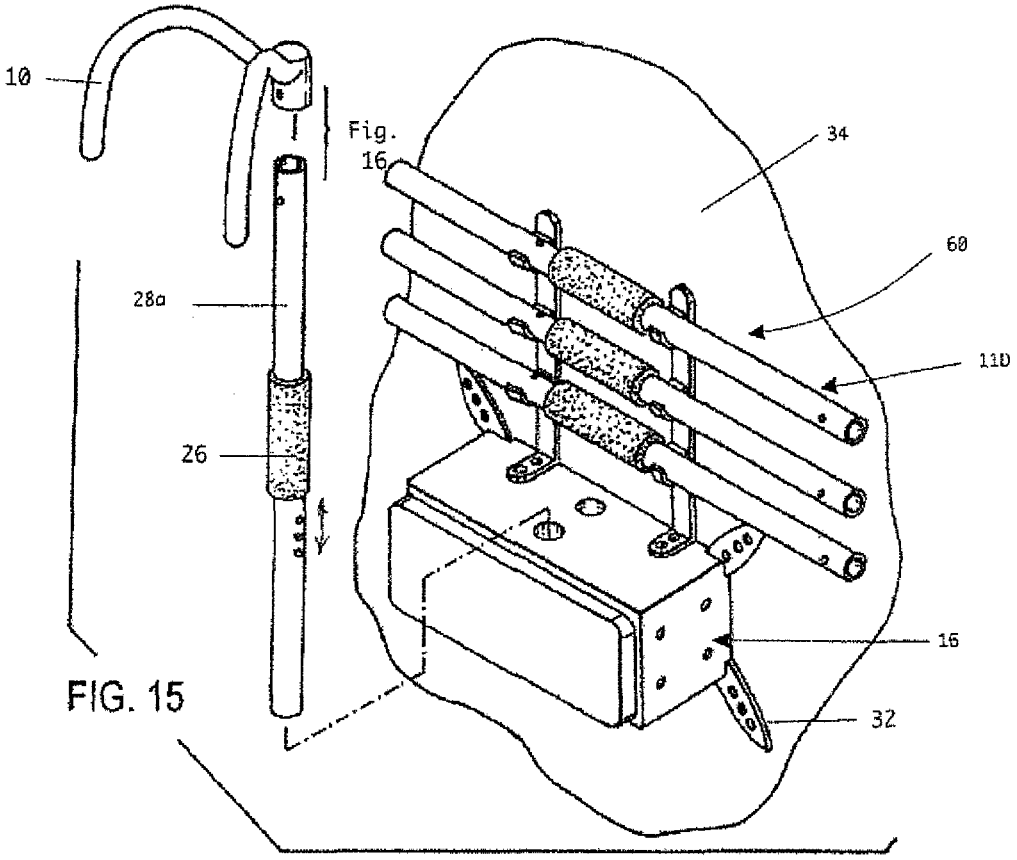
FIG. 15 is view of an adjustment kit in accordance with the present disclosure, it is to be understood that the entire assembly and system may be provided in a kit (as noted in FIG. 4)
Figure 16:
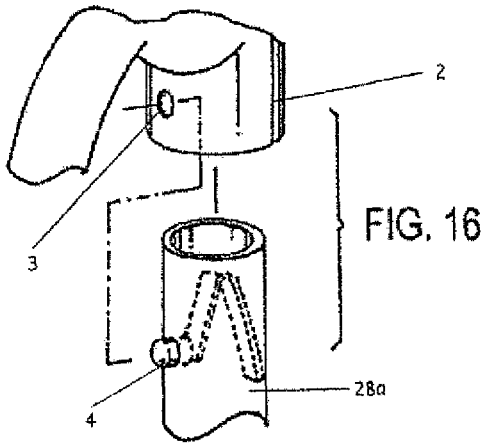
FIG. 16 is an enlarged view of the indicated area of FIG. 15.

A kit as shown in FIG. 15 may include the exercise apparatus 100 and may further include a stand 60, which may be coupled or secured to the housing 16, for retaining one or more bending mechanisms, e.g., bending mechanisms 11, 11B, 11C and 11D. Also as shown in FIGS. 15 and 16, a bending mechanism 11D may be separable from the handle bars 10. For example, handle bars 10 may include a mounting section 2 including a hole 3 in which a spring loaded pin 4 of the upper tube 28*a* may releasably engage the hole 3. In particular, the pin 4 is biased toward engages the hole 3 and can be depressed when disengaging the handles 10 from the upper tube 28*a* such that a different biasing member 11D that may have a different flexural resistance may be selected depending upon the strength of the user and the particular abdominal exercise being performed.

It will be further understood that as an alternative assembly, a kit may adaptively include a variety of alternative spring members (14, 14*a*, 14*b*, etc.) or alternative sleeve members 27 (e.g., multiple sleeve members) or optional assembly members 60 as otherwise discussed herein. Such alternatives may be differently assembled in differing kits without departing from the scope and spirit of the present invention as will be understood by those of skill in the art.

Having described at least one of the preferred embodiments of the present disclosure with reference to the accompanying drawings, it will be apparent to those skills that the disclosure is not limited to those precise embodiments, and that various modifications and variations can be made in the presently disclosed system without departing from the scope or spirit of the disclosure. Thus, it is intended that the present disclosure cover modifications and variations of this disclosure provided they come within the scope of the appended claims and their equivalents.

What is claimed is:

1. An exercise apparatus comprising:

a housing having a height, the housing configured to be mounted to an external upright surface, a first longitudinal axis defined extending through the height;

a biasing member, the biasing member including a substantially rigid upper section, a substantially rigid lower section, and a flexible joint therebetween, the flexible joint providing a flexural resistance, wherein the lower section is coupled to the housing and a second longitudinal axis defined extending through the upper section; and a handle coupled to the upper section, wherein the biasing member is transitionable between a first position in which the first longitudinal axis and the second longitudinal axis are generally collinear, and a second position in which the first longitudinal axis and the second longitudinal axis are at an angle with respect to one another, the biasing member being biased toward the first position;

a foot rest, the foot rest being coupled to the housing;

the foot rest includes a support surface, the surface defining a geometric plane, the support surface being transitionable between a first position in which the plane is pivotable with respect to the first longitudinal axis and a second position in which the plane is substantially orthogonal to the first longitudinal axis; and the foot rest is movable relative to said surface whereby, said foot rest is stowable between uses for enhanced convenience without removing said exercise apparatus from said surface.

2. The exercise apparatus of claim 1, wherein: the flexible joint includes a flexible tube and at least one spring element disposed within the tube.

3. The exercise apparatus of claim 2, wherein: the at least one spring element includes a first and second spring.

4. The exercise apparatus of claim 3, wherein: the first and second springs are intertwined such that they define a common central axis extending lengthwise therethrough.

5. The exercise apparatus of claim 2, wherein a flexible sleeve is disposed within the spring element, the sleeve being substantially aligned with the tube.

6. The exercise apparatus of claim 1, wherein: the biasing member is releasably coupled to both the housing and the handle.

7. The exercise apparatus of claim 1, wherein:

the handle includes a pair of handles that are configured to conform to a shape of user's shoulders.

8. An exercise kit comprising:

an exercise apparatus comprising:

a housing having a height, the housing configured to be mounted to a surface, a first longitudinal axis extending through the height;

at least one biasing member, the biasing member including a substantially rigid upper section, a substantially rigid lower section, and a flexible joint therebetween, the flexible joint providing a flexural resistance, wherein the lower section is coupled to the housing and a second longitudinal axis extends through the upper section; and a handle coupled to the upper section, wherein the at least one biasing member is transitionable between a first position in which the first longitudinal axis and the second longitudinal axis are generally parallel or collinear, and a second position in which the first longitudinal axis and the second longitudinal axis are orthogonal with respect to one another, the biasing member being biased toward the first position, wherein the at least one biasing member is releasably coupled to the housing and to the handle, the at least one biasing member including a plurality of biasing members, each of the plurality of biasing members having a different flexural resistance;

a foot rest, the foot rest being coupled to the housing;

the foot rest includes a support surface, the surface defining a geometric plane, the support surface being transitionable between a first position in which the plane is pivotable with respect to the first longitudinal axis and a second position in which the plane is substantially orthogonal to the first longitudinal axis; and the foot rest is movable relative to said surface whereby, said foot rest is stowable between uses for enhanced convenience without removing said exercise apparatus from said surface.

9. The exercise kit of claim 8, wherein:

the flexible joint includes a biasing element.

10. The exercise kit of claim 9, wherein: the biasing element includes one or more springs.

11. The exercise kit of claim 10, wherein: the one or more springs are intertwined.

12. The exercise kit of claim 10, wherein: the biasing element includes a flexible material selected from one of a rubber and an elastic material.

13. The exercise kit of claim 8, further comprising:

a mounting bracket, the mounting bracket being configured to secure the housing to an external surface.

* * * * *